US005172170A

United States Patent [19]

Hays et al.

[11] Patent Number: 5,172,170

[45] Date of Patent: Dec. 15, 1992

[54] ELECTRODED DONOR ROLL FOR A SCAVENGELESS DEVELOPER UNIT

[75] Inventors: Dan A. Hays; Michael A. Morgan, both of Fairport; William H. Wayman, Ontario; Paul J. Brach, Rochester; Joseph C. Mammino, Penfield, all of N.Y.

[73] Assignee: Xerox Corporation, Stamford, Conn.

[21] Appl. No.: 851,411

[22] Filed: Mar. 13, 1992

[51] Int. Cl.[5] ..... G03G 15/08

[52] U.S. Cl. ..... 355/259; 29/895; 118/653

[58] Field of Search ..... 355/245, 246, 247, 259; 118/653, 654; 29/895, 895.32

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,367 | 4/1991 | Hays | 355/247 |

FOREIGN PATENT DOCUMENTS

| | | | |
|---|---|---|---|
| 61-277982 | 12/1986 | Japan | 355/246 |
| 1-99074 | 4/1989 | Japan | 355/259 |
| 3-12680 | 1/1991 | Japan | 355/246 |
| 3-15874 | 1/1991 | Japan | 355/246 |

*Primary Examiner*—Joan H. Pendegrass

*Attorney, Agent, or Firm*—H. Fleischer; J. E. Beck; R. Zibelli

[57] ABSTRACT

An apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone. In the development zone, toner is attracted from the toner cloud to the latent image. In this way, the latent image is developed with toner.

16 Claims, 3 Drawing Sheets

ELECTRODED DONOR ROLL FOR A SCAVENGELESS DEVELOPER UNIT

This invention relates generally to an electrophotographic printing machine, and more particularly concerns a donor roll having electrode wires integral therewith for use in a scavengeless developer unit.

Generally, the process of electrophotographic printing includes charging a photoconductive member to a substantially uniform potential so as to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two-component and single-component developer materials are commonly used. A typical two-component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development unit employs a magnetic brush developer roller for transporting carrier having toner particles adhering triboelectrically thereto. The donor roll and magnetic roll are electrically biased relative to one another. Toner is attracted to the donor roll from the magnetic roll. The electrically biased electrode wires detach the toner from the donor roll forming a toner powder cloud in the development zone. The latent image attracts the toner particles thereto from the toner powder cloud. In this way, the latent image recorded on the photoconductive member is developed with toner particles. It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to eliminate the externally located electrode wires. Various types of development systems have hereinbefore been used as illustrated by the following disclosures, which may be relevant to certain aspects of the present invention:

U.S. Pat. No. 4,868,600
Patentee: Hays et al.
Issued: Sep. 19, 1989
U.S. Pat. No. 4,984,019
Patentee: Folkins
Issued: Jan. 8, 1991
U.S. Pat. No. 5,010,367

Patentee: Hays
Issued: Apr. 23, 1991

The relevant portions of the foregoing disclosures may be briefly summarized as follows:

U.S. Pat. No. 4,868,600 describes an apparatus wherein a magnetic roll transports two component developer material to a transfer region wherein toner from the magnetic roll is transferred to donor roll. The donor roll transports toner to a region opposed from a surface on which a latent image is recorded. A pair of electrode wires are positioned in the space between the surface and the donor roll and are electrically biased to detach toner from the donor roll to form a toner cloud. Detached toner from the cloud develops the latent image.

U.S. Pat. No. 4,984,019 discloses a developer unit having a donor roll with electrode wires disposed adjacent thereto in a development zone. A magnetic roller transports developer material to the donor roll. Toner particles are attracted from the magnetic roller to the donor roll.

U.S. Pat. No. 5,010,367 describes a scavengeless development system in which a pair of electrode wires are placed closely adjacent to a toned donor roll within the gap between the donor roll and photoconductive belt. The combination of an AC voltage on the donor roll with an AC voltage between the electrode wires and the donor roll permits efficient detachment of toner from the donor roll forming a toner powder cloud in close proximity to the photoconductive belt.

In accordance with one aspect of the present invention, there is provided an apparatus for developing a latent image recorded on a surface. The apparatus includes a housing defining a chamber for storing at least a supply of toner therein. A moving donor member is spaced from the surface and adapted to transport toner from the chamber of the housing to a development zone adjacent the surface. An electrode member is integral with the donor member and adapted to move therewith. The electrode member is electrically biased to detach toner from the donor member to form a cloud of toner in the space between the electrode member and the surface. This detached toner develops the latent image.

Pursuant to another aspect of the present invention, there is provided an electrophotographic printing machine of the type in which an electrostatic latent image recorded on a photoconductive member is developed with toner to form a visible image thereof. The printing machine includes a housing defining a chamber storing at least a supply of toner therein. A moving donor member is spaced from the photoconductive member and adapted to transport toner from the chamber of the housing to a development zone adjacent the photoconductive member. An electrode member is integral with the donor member and adapted to move therewith. The electrode member is electrically biased to detach toner from the donor member to form a cloud of toner in the space between the electrode member and the photoconductive member. This detached toner develops the latent image.

Still another aspect of the present invention is a method of manufacturing a donor roller adapted to be used in a developer unit. The method of manufacturing the donor roll includes the steps of forming a plurality of spaced grooves in an electrically conductive member. At least the grooves are coated with a layer of dielectric material. A substantial portion of the dielectric coated grooves are filled with a conductive material.

Other features of the present invention will become apparent as the following description precedes and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
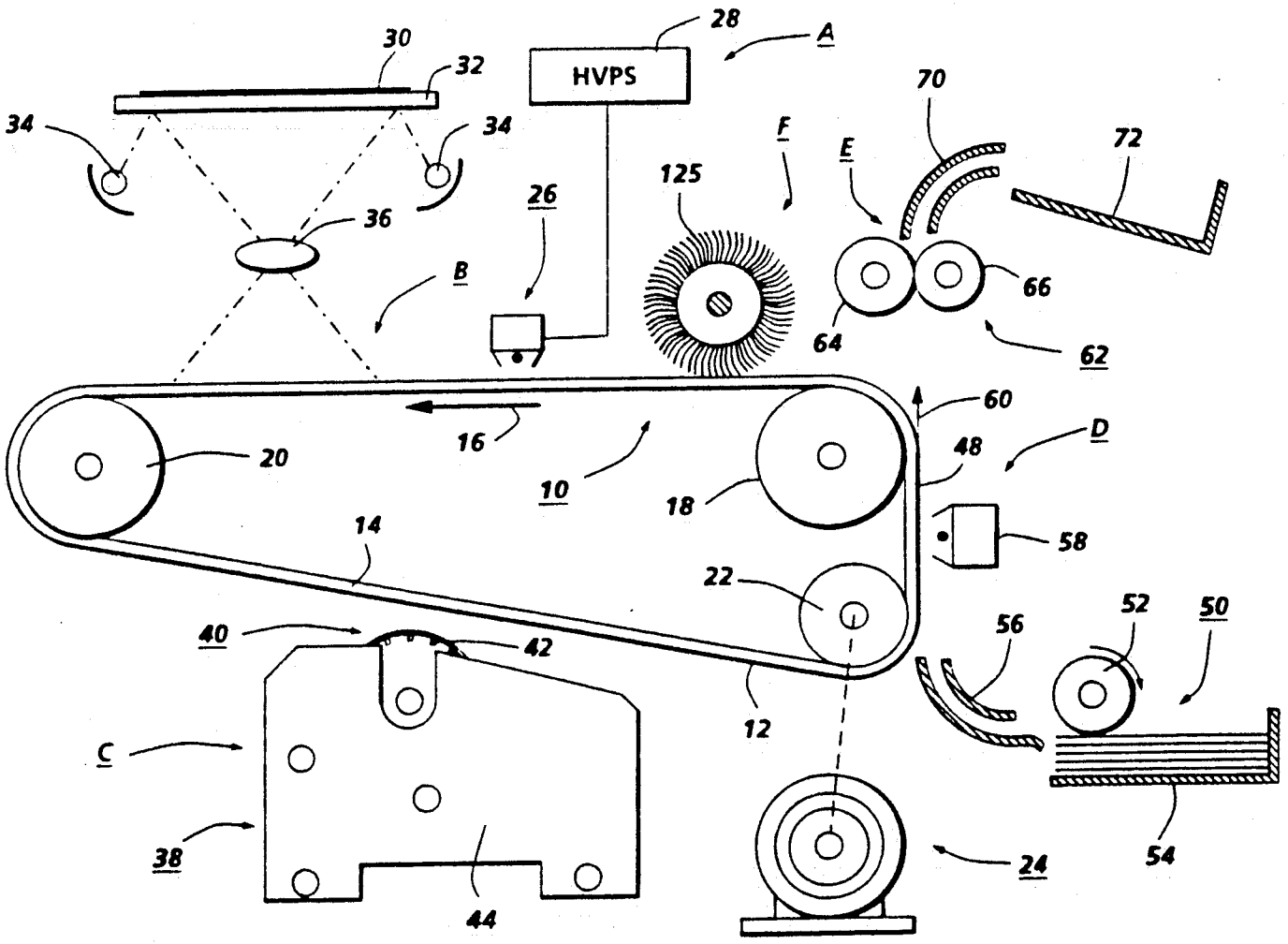
FIG. 3 is a schematic elevational view of an illustrative electrophotographic printing machine incorporating the FIG. 2 development apparatus therein.

Referring initially to FIG. 3, there is shown an illustrative electrophotographic printing machine incorporating the development apparatus of the present invention therein. The electrophotographic printing machine employs a belt 10 having a photoconductive surface 12 deposited on an electrically grounded conductive substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a suitable pair of springs (not shown) resiliently urging tensioning roller 20 against belt 10 with the desired spring force. Stripping finger 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. Alternatively, a raster output scanner may be used in lieu of the light lens system previously described to layout an image in a series of horizontal scan lines with each line having a specified number of pixels per inch. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes a donor roller 40 having a plurality of electrodes or electrical conductors 42 embedded therein and integral therewith. The electrical conductors are substantially equally spaced and located closely adjacent to the circumferential surface of donor roll 40. Electrical conductors 42 are electrically biased in the development zone to detach toner from donor roll 40. In this way, a toner powder cloud is formed in the gap between donor roll 40 and photoconductive surface 12. The latent image recorded on photoconductive surface 12 attracts toner particles from the toner powder cloud forming a toner powder image thereon. Donor roller 40 is mounted, at least partially, in the chamber of developer housing 44. The chamber in developer housing 44 stores a supply of developer material. The developer material is a two-component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller at a loading zone. Developer unit 38 will be discussed hereinafter, in greater detail, with reference to FIG. 1.

With continued reference to FIG. 3, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 135 in contact with photoconductive surface 12. The particles are cleaned from photoconductive surface 12 by the rotation of brush 135 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
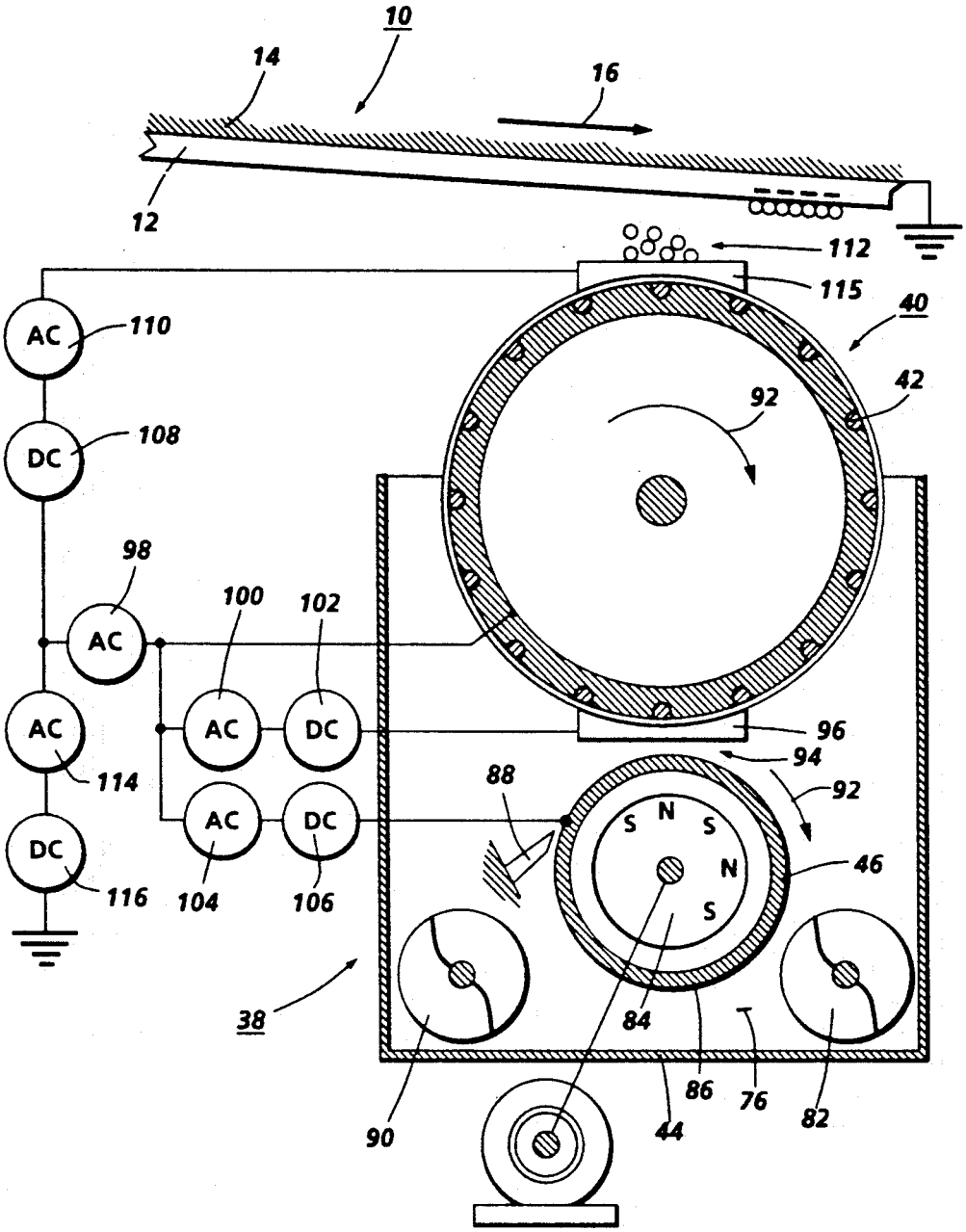
FIG. 1 is a schematic elevational view showing the development apparatus used in the FIG. 3 printing machine.

Referring now to FIG. 1, there is shown developer unit 38 in greater detail. As shown thereat, developer unit 38 includes a housing 44 defining a chamber 76 for storing a supply of developer material therein. Donor roll 40 has electrical conductors 42 positioned in grooves about the peripheral circumferential surface thereof. The electrical conductors are substantially equally spaced from one another and insulated from the body of donor roll 40 which is electrically conductive. Donor roll 40 rotates in the direction of arrow 92. A magnetic roller 46 is also mounted in chamber 76 of developer housing 44. Magnetic roller 46 is shown rotating in the direction of arrow 92. An alternating voltage source 100 and a constant voltage source 102 electrically bias donor roll 40 in the toner loading zone. Magnetic roller 46 is electrically biased by AC voltage source 104 and DC voltage source 106. Normally both of these voltages are set to zero. The relative voltages between donor roll 40 and magnetic roller 46 are selected to provide efficient loading of toner on donor roll 40 from the carrier granules adhering to magnetic roller 46. Furthermore, reloading of developer material on magnetic roller 46 is also enhanced. In the development zone, voltage sources 108 and 110 electrically bias electrical conductors 42 to a DC voltage having an AC voltage superimposed thereon. Voltage sources 108 and 110 are in wiping contact with isolated electrodes 42 in development zone. As donor roll 40 rotates in the direction of arrow 68, successive electrodes 42 advance into the development zone 112 and are electrically biased by voltage sources 108 and 110. As shown in FIG. 1, wiping brush 115 contacts isolated electrodes 42 in development zone 112 and is electrically connected to voltage sources 108 and 110. In this way, isolated electrodes or electrical conductors 42 advance into development zone 112 as donor roll 40 rotates in the direction of arrow 68. Isolated electrodes, i.e. electrical conductors 42, in development zone 112, contact wiping brush 115 and are electrically biased by voltage sources 110 and 108. In this way, an AC voltage difference is applied between the isolated electrical conductors and the donor roll detaching toner from the donor roll and forming a toner powder cloud. Voltage 108 can be set at an optimum bias that will depend upon the toner charge, but usually the voltage is set at zero. The electroded donor roll assembly is biased by voltage sources 114 and 116. DC voltage source 116 controls the DC electric field between the assembly and photoconductive belt 10 for the purpose of suppressing background deposition of toner particles. AC voltage source 98 applies a AC voltage on the core of donor roll 40 for the purpose of applying an AC electric field between the core of the donor roll and conductors 42, as well as between the donor roll and photoconductive belt 10. Although either of the AC voltages 98 and 110 could be zero, other voltages must be non-zero so that a toner cloud can be formed in the development zone. For a particular toner and gap in the development zone between the donor roll and photoconductive belt, the amplitude and frequency of the AC voltage being applied on donor roll 40 by AC voltage supply 114 can be selected to position the toner powder cloud in close proximity to the photoconductive surface of belt 10, thereby enabling development of an electrostatic latent image consisting of fine lines and dots. It should also be noted that a wiping brush 96 engages donor roll 40 in loading zone 94. This insures that the donor roll is appropriately electrically biased relative to the electrical bias applied to the magnetic roller 46 in loading zone 94 so as to attract toner particles from the carrier granules on the surface of magnetic roller 46. Magnetic roller 46 advances a constant quantity of toner having a substantially constant charge onto donor roll 40. This insures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a non-magnetic tubular member 86 made preferably from aluminum and having the exterior circumferential surface thereof roughened. An elongated magnetic 84 is positioned interiorly of and spaced from the tubular member. The magnet is mounted stationarily. The tubular member rotates in the direction of arrow 92 to advance the developer material adhering thereto into a loading zone 94. In loading zone 94, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in the direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The auger and the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferro magnetic core having a thin layer of magnetite overcoated with a non-continuous layer of resinous material. The toner particles are made from a resinous material, such as a vinyl polymer mixed with a coloring material, such as chromogen black. The developer material comprises from about 95% to about 99% by weight of carrier and from 5% to about 1% by weight of toner. However, one skilled in the art will recognize that any other suitable developer material may be used.

Figure 2:
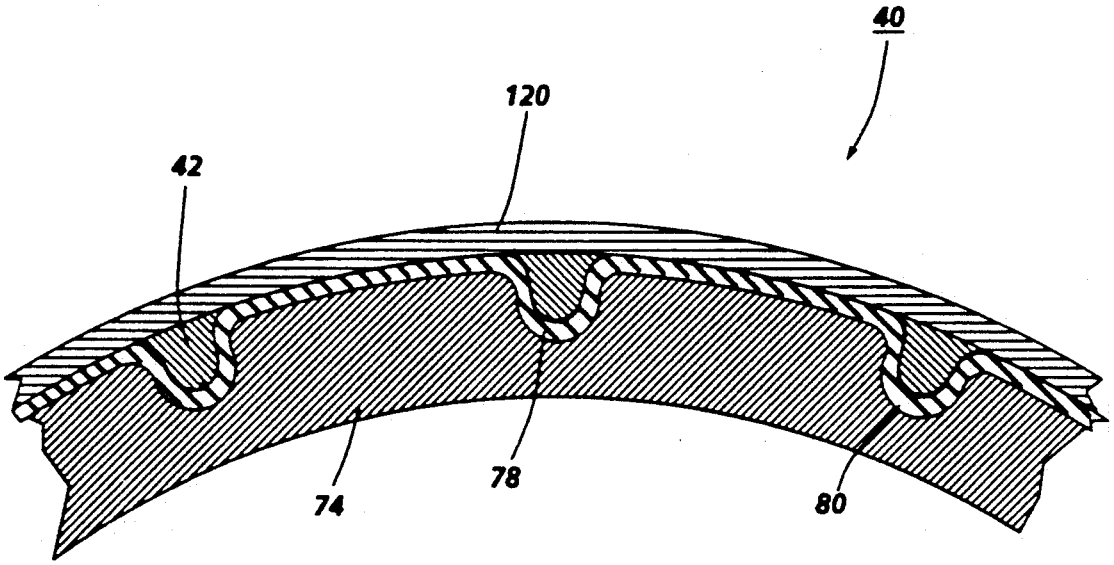
FIG. 2 is a fragmentary, sectional elevational view depicting a portion of the donor roll having the electrode wires integral therewith.

Referring now to FIG. 2, there is shown a fragmentary sectional elevational view of donor roller 40. As depicted thereat, donor roller 40 includes a sleeve 74 having substantially equally spaced grooves 78 in the exterior circumferential surface thereof. Grooves 78 extend in a direction substantially parallel to the longitudinal axis of donor roller 40. Sleeve 74 is made from a conductive material such as aluminum. Grooves 78 are typically 50 to 150 microns wide and approximately 100 microns deep. The spacing between adjacent grooves is about 150 microns. A dielectric undercoating layer 80 is applied to the exterior circumferential surface of sleeve 74. Dielectric coating 80 may cover the interior surface of grooves 78. In addition, dielectric coating 80 covers the region between adjacent grooves 78 on the circumferential surface of sleeve 74 as shown in FIG. 2, or there could e no dielectric coating between the conductors. The dielectric undercoating layer may be anodized aluminum or a polymer with an overall thickness of from about 25 to about 75 microns and is applied directly on conductive sleeve 74 by spraying, dipping, powder spraying, fluidized bed or any other suitable technique. The dielectric coating may also be inorganic, such as various oxide, flame spray coated and ceramics. Typical representative polyurethanes, polyesters, polytetra fluorethylenes, polycarbonates, poly arylethers, polybutadienes, polysulfones, polyimides, polyamides, phenoxy and pheoxlics. An electrically conductive material is applied in grooves 78 over dielectric coating 80 therein. The electrically conductive material forms electrical conductors 42. The electrical conductors 42 have an electrical conductivity of about $10^{-3}$ ohms-centimeters. A suitable electrically conductive material is a silver conductive epoxy or paint. The conductive material can be applied to the grooves by an annular meniscus coater or any other suitable method so that isolated conductors are created. A charge relaxable layer 120 is coated on the entire circumferential surface of donor roll 40 to prevent electrical shorting between electrical conductors 42 and the brush of conductive magnetic developer material extending outwardly from magnetic roller 46 in loading zone 94. Preferably, the charge relaxable layer has a thickness about 5 microns. The conductivity of the charge relaxable layer must be sufficient to dissipate charge accumulation over a time period of seconds and yet sufficiently resistive to allow the fringe electric fields to penetrate through the coating for times on the order of milliseconds and less. The charge relaxable layer can be applied by spray or dip coating.

In recapitulation, it is evident that the developer unit of the present invention includes electrical conductors positioned in grooves of a donor roll used in a hybrid scavengeless developer unit. The electrical conductors rotate with the donor roll and are appropriately electrically biased in the development zone so as to detach toner particles from the donor roll forming a toner powder cloud thereat. The toner particles in the powder cloud are attracted to the latent image recorded on the photoconductive surface the develop it.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface, including;

a housing defining a chamber storing at least a supply of toner therein;

a moving donor member spaced from the surface and adapted to transport toner from the chamber of said housing to a development zone adjacent the surface;

an electrode member includes a plurality of electrical conductors with adjacent electrical conductors being spaced from one another, said electrode member being integral with said donor member and adapted to move therewith, said electrode member being electrically biased to detach toner from said donor member to form a cloud of toner in the space between said electrode member and the surface with toner developing the latent image, said donor member includes a roll having a plurality of grooves therein with adjacent grooves being spaced from one another with one of said electrical conductors being located in one of the grooves in said roll; and a dielectric layer disposed in at least the grooves of said roll interposed between said roll and said electrical conductors, wherein said roll is made from a conductive material and said dielectric layer is disposed about the circumferential surface of said roll between adjacent grooves.

2. An apparatus according to claim 1, further including a charge relaxable layer contacting said electrical conductors and said dielectric layer disposed about the circumferential surface of said roll between adjacent grooves.

3. An apparatus according to claim 1, further including:

means for advancing carrier granules having toner particles adhering triboelectrically thereto to a loading zone adjacent said donor roll; and means for electrically biasing said donor roll and said advancing means relative to one another so as to attract toner particles from the carrier granules on said advancing means to said donor roll.

4. An apparatus according to claim 3, wherein said biasing means applies an AC potential and a DC potential on said donor roll and on said advancing means in the loading zone.

5. An apparatus according to claim 4, wherein said biasing means applies an AC potential and a DC potential on said electrical conductors in the development zone.

6. An apparatus according to claim 5, wherein said biasing means applies an AC potential on said donor roll.

7. An apparatus according to claim 6, wherein said advancing means includes magnetic means for advancing the carrier granules having toner particles adhering triboelectrically thereto to the loading zone adjacent said donor roll.

8. An electrophotographic printing machine of the type in which an electrostatic latent image recorded on a photoconductive member is developed with toner to form a visible image thereof, wherein the improvement includes:

a housing defining a chamber storing at least a supply of toner therein;

a moving donor member spaced from the photoconductive member and adapted to transport toner from the chamber of said housing to a development zone adjacent the photoconductive member, an electrode member integral with said donor member and adapted to move therewith, said electrode member includes a plurality of electrical conductors with adjacent electrical conductors being spaced from one another, said electrode member being electrically biased to detach toner from said donor member to form a cloud of toner in the space between said electrode member and the surface with the toner developing the latent image, said donor member includes a roll made from a conductive material having a plurality of grooves therein with adjacent grooves being spaced from one another with one of said electrical conductors being mounted in one of the grooves in said roll; and a dielectric layer disposed in at least the grooves of said roll interposed between said roll and said electrical conductors, said dielectric layer is disposed about the circumferential surface of said roll between adjacent grooves.

9. A printing machine according to claim 8, further including a charge relaxable layer contacting said electrical conductors and said dielectric layer disposed about the circumferential surface of said roll between adjacent grooves.

10. A printing machine according to claim 8, further including:

means for advancing carrier granules having toner particles adhering triboelectrically thereto to a loading zone adjacent said donor roll; and means for electrically biasing said donor roll and said advancing means relative to one another so as to attract toner particles from the carrier granules on said advancing means to said donor roll.

11. A printing machine according to claim 10, wherein said biasing means applies an AC potential and a DC potential on said donor roll and on said advancing means in the loading zone.

12. A printing machine machine according to claim 11, wherein said biasing means applies an AC potential and a DC potential on said electrical conductors in the development zone.

13. A printing machine according to claim 12, wherein said biasing mean applies an AC potential on said donor roll.

14. A printing machine according to claim 13, wherein said advancing means includes magnetic means for advancing the carrier granules having toner particles adhering triboelectrically thereto to the loading zone adjacent said donor roll.

15. A method of manufacturing a donor roll adapted to be used in a developer unit, including the steps of:

forming a plurality of spaced grooves in an electrically conductive cylindrical member;

coating at least the grooves and the region of the roll between adjacent grooves with the layer of dielectric material; and filling a substantial portion of the dielectric coated grooves with a conductive material.

16. A method according to claim 15, further including the step of depositing a charge relaxable layer over the conductive material in the dielectric coated grooves and the dielectric material coated region of the roll between adjacent grooves.

* * * * *